US006412448B1

(12) United States Patent
Kingston

(10) Patent No.: US 6,412,448 B1
(45) Date of Patent: Jul. 2, 2002

(54) WATER HEATER CONSTRUCTION

(76) Inventor: James E. Kingston, 1108 McRae Rd., Arlington, WA (US) 98223

( * ) Notice: Subject to any disclaimer, the term of this patent is extended or adjusted under 35 U.S.C. 154(b) by 0 days.

(21) Appl. No.: 09/785,666

(22) Filed: Feb. 16, 2001

Related U.S. Application Data

(60) Provisional application No. 60/183,175, filed on Feb. 17, 2000.

(51) Int. Cl.[7] ..... F22B 37/36

(52) U.S. Cl. ..... 122/19.2; 122/494; 220/495.01; 220/495.05

(58) Field of Search ..... 122/19.2, 4 R, 122/234, 235.14, 494, 511, 512; 126/373.1, 390.1; 220/495.01, 495.05, 567.3

(56) References Cited

U.S. PATENT DOCUMENTS

| | | | | |
|---|---|---|---|---|
| 3,134,008 | A | | 5/1964 | Finn |
| 4,253,009 | A | | 2/1981 | Jordan |
| 4,296,799 | A | | 10/1981 | Steele |
| 4,848,616 | A | | 7/1989 | Nozaki |
| 4,981,112 | A | * | 1/1991 | Adams et al. ..... 122/19.2 |
| 5,188,143 | A | * | 2/1993 | Krebs ..... 122/13.01 |
| 5,305,419 | A | | 4/1994 | Cameron |
| 5,371,831 | A | | 12/1994 | Gauer et al. |
| 5,404,421 | A | | 4/1995 | Wallace et al. |
| 5,551,590 | A | * | 9/1996 | Mazur et al. ..... 220/495.05 |
| 5,555,997 | A | | 9/1996 | Nogles |
| 5,668,922 | A | * | 9/1997 | Ross et al. ..... 122/19.2 |
| 5,923,819 | A | | 7/1999 | Ross et al. |
| 5,949,960 | A | | 9/1999 | Hall |
| 5,979,371 | A | * | 11/1999 | Lewis ..... 122/494 |
| D440,537 | S | | 4/2001 | Pope |
| D440,547 | S | | 4/2001 | Hori et al. |
| D440,612 | S | | 4/2001 | Arnold et al. |
| 6,217,000 | B1 | | 4/2001 | Younie et al. |
| 6,217,525 | B1 | | 4/2001 | Medema et al. |
| 6,217,775 | B1 | | 4/2001 | Conca et al. |
| 6,218,507 | B1 | | 4/2001 | Gao et al. |

* cited by examiner

*Primary Examiner*—Gregory Wilson
(74) *Attorney, Agent, or Firm*—Christensen O'Connor Johnson Kindness PLLC

(57) ABSTRACT

A flexible, water impervious liner is fitted in a rigid outer shell. The shell has an open top with a peripheral flange over which a top lip of the liner is fitted. A separate top plate attaches to the flange with standard fasteners for clamping the liner to the shell. Through hull fittings are provided for heating elements at the side and inlet/outlet fittings at the top. The construction allows convenient access to virtually all components of the water heater, including the liner and the heating elements, so that they can be quickly and easily serviced or replaced. A desired amount of insulation can be provided by an appropriate cover or blanket to surround the outer shell.

10 Claims, 6 Drawing Sheets

WATER HEATER CONSTRUCTION

CROSS-REFERENCE TO RELATED APPLICATION

This application claims the benefit of U.S. provisional patent application No. 60/183,175, filed Feb. 17, 2000.

FIELD OF THE INVENTION

The present invention relates to a water heater, component parts thereof and a system for assembling a water heater.

BACKGROUND OF THE INVENTION

Conventional water heaters have an upright cylindrical metal tank, an outer jacket spaced from the wall of the tank, and an intervening layer of insulation, such as foam insulation, interposed between the tank and the jacket. Heating elements typically extend horizontally into the tank from a side, and inlet and outlet pipes typically extend through the top of the tank, as well as one or more pipes or openings for additional components such as a temperature and/or pressure relief valve.

In general, conventional water heaters are expensive and labor intensive to build. In addition, the tank is subject to corrosion, necessitating replacement of the entire water heater. At most, limited servicing is possible, and more often servicing is not financially feasible. When problems occur, the entire water heater is scrapped. This is not only time consuming, expensive and inconvenient, but also a waste of resources and a disposal or recycling problem.

SUMMARY OF THE INVENTION

The present invention provides a water heater construction allowing easy access and replacement of components for maintenance. In one aspect of the invention, no inner metal tank is used. Rather, a flexible, water impervious liner is fitted in an outer shell. The liner holds the quantity of water to be heated and prevents the water from coming into contact with the shell, which may be metal. The shell is rigid and strong enough to withstand the water pressure without deforming. The shell can have an open top with a peripheral horizontal flange over which a top lip of the liner is fitted. A separate top plate attaches to the flange with standard fasteners for clamping the liner to the shell. Through hull fittings are provided for heating elements at the side and inlet/outlet conduits at the top. If, over time, the liner weakens, ruptures, or becomes damaged, the liner is easily replaceable without having to scrap the other components. Similarly, the construction allows convenient access to virtually all components of the water heater, including the heating elements, so that they can be quickly and easily replaced. A desired amount of insulation can be provided by selecting an appropriate cover or blanket to surround the outer shell. This blanket or cover can be in a form which allows its replacement, such as by use of a drawstring bag having a thin or thick insulating wall.

In another aspect of the invention, the improved construction will reliably indicate if there has been a rupture of the liner. This can be accomplished by providing a top valve communicating with the space between the liner and shell so that water leaking from the liner will be detected. Alternatively or additionally, nontoxic dye can be arranged between the liner and the shell so that should a rupture occur, the dye will bleed into the water and be readily detected.

These and other improvements are described in more detail below.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
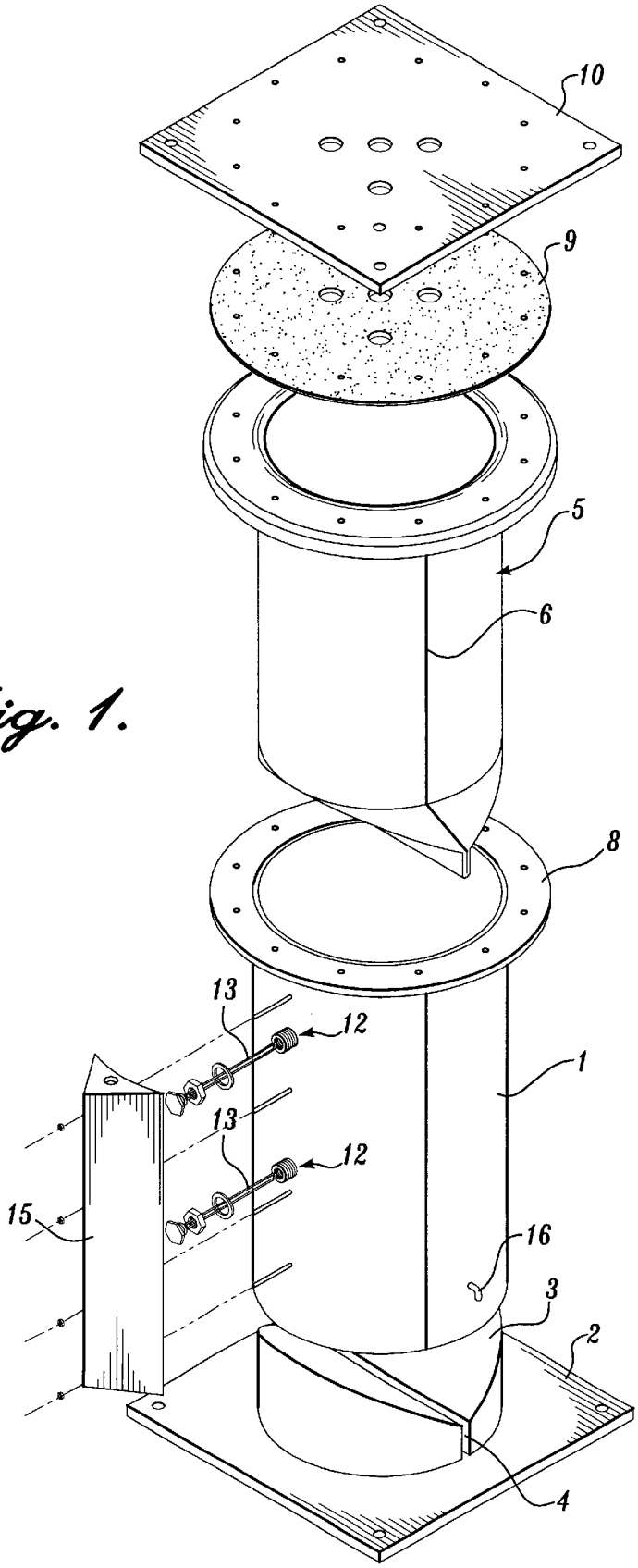
FIG. 1 is a top perspective of a first embodiment of a water heater construction in accordance with the present invention, with parts shown in exploded relationship.
Figure 2:
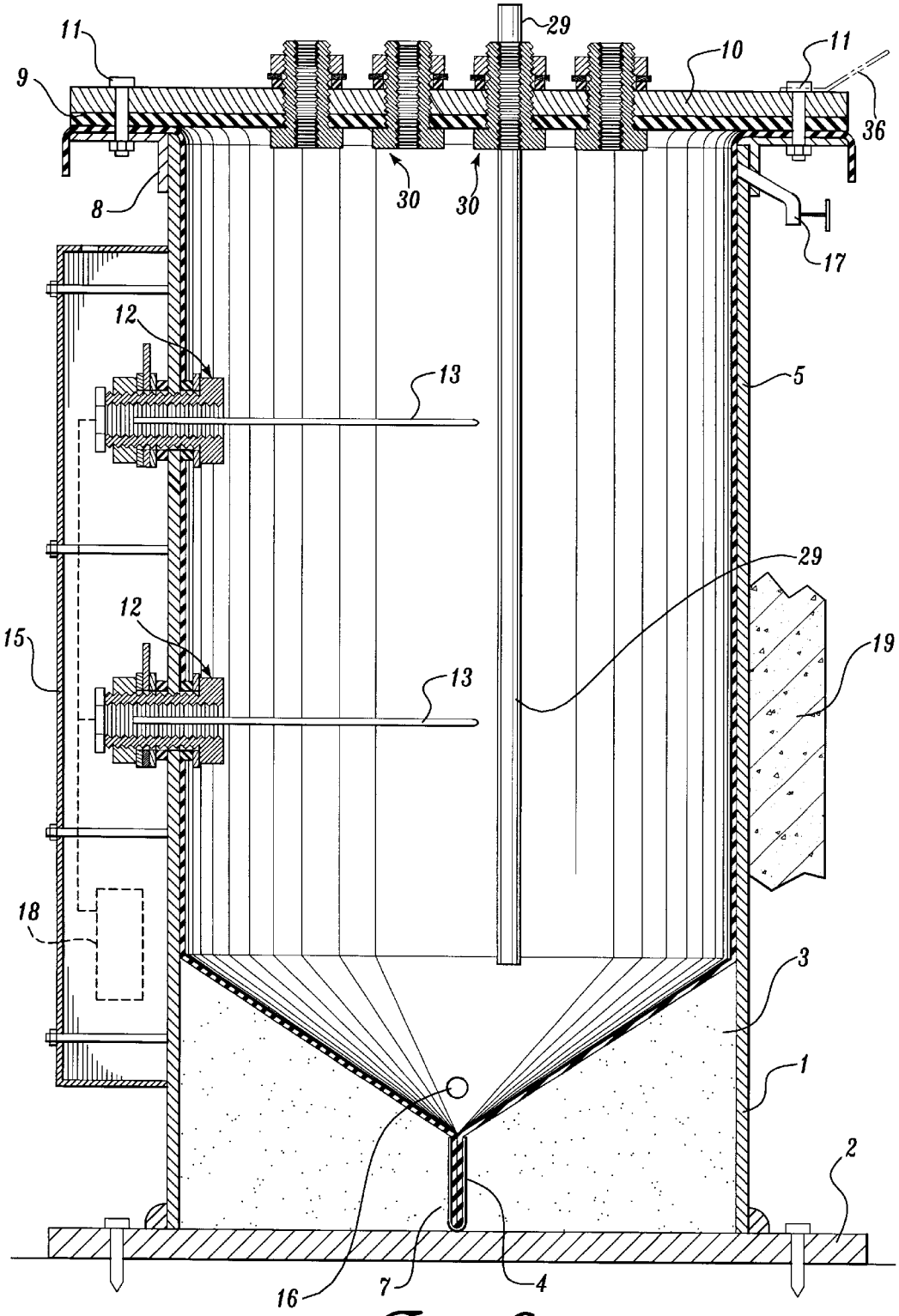
FIG. 2 is a vertical section of the water heater construction of FIG. 1 with the parts assembled.

With reference to FIG. 1 and FIG. 2, one embodiment of a water heater in accordance with the present invention includes a cylindrical, thin, rigid shell 1, preferably metal, which can be secured to a base 2, such as by welding. The shell can be formed from a single sheet having its opposite ends joined at a lap joint or a butt joint. Two insulating blocks 3 fit in the bottom of the shell, each of approximately semi-circular shape and inclined from a side of the shell toward the center. A diametral groove 4 is formed between the two insulating blocks 3. A liner 5 of flexible material is formed from a single sheet of neoprene or other temperature resistant, essentially inert material. First, the liner is formed into a tube with a sealed lap joint 6, then the bottom portion of the tube is pinched together and sealed. A spring clamp 7, seen in FIG. 2, can assist in sealing the pinched bottom end of the liner. Such end fits within the groove 4 between the blocks 3.

The upper end of the shell 1 has a reinforcing angle flange 8 which can be attached by welding or any other secure attachment. The upper end portion of the liner is stretched over the flange and clamped against it by a gasket 9 and a top plate 10. The top plate has holes for inlet and outlet pipes, a pressure-temperature relief valve, and any other desired accessories or components such as a pressure indicator, second outlet, or anode, for example. Clamping of the liner can be achieved by several bolts 11 (FIG. 2) spaced circumferentially of the angle flange 8. Alternatively, a full circle clamp ring could be used, with conveniently removable fasteners.

Figure 3:
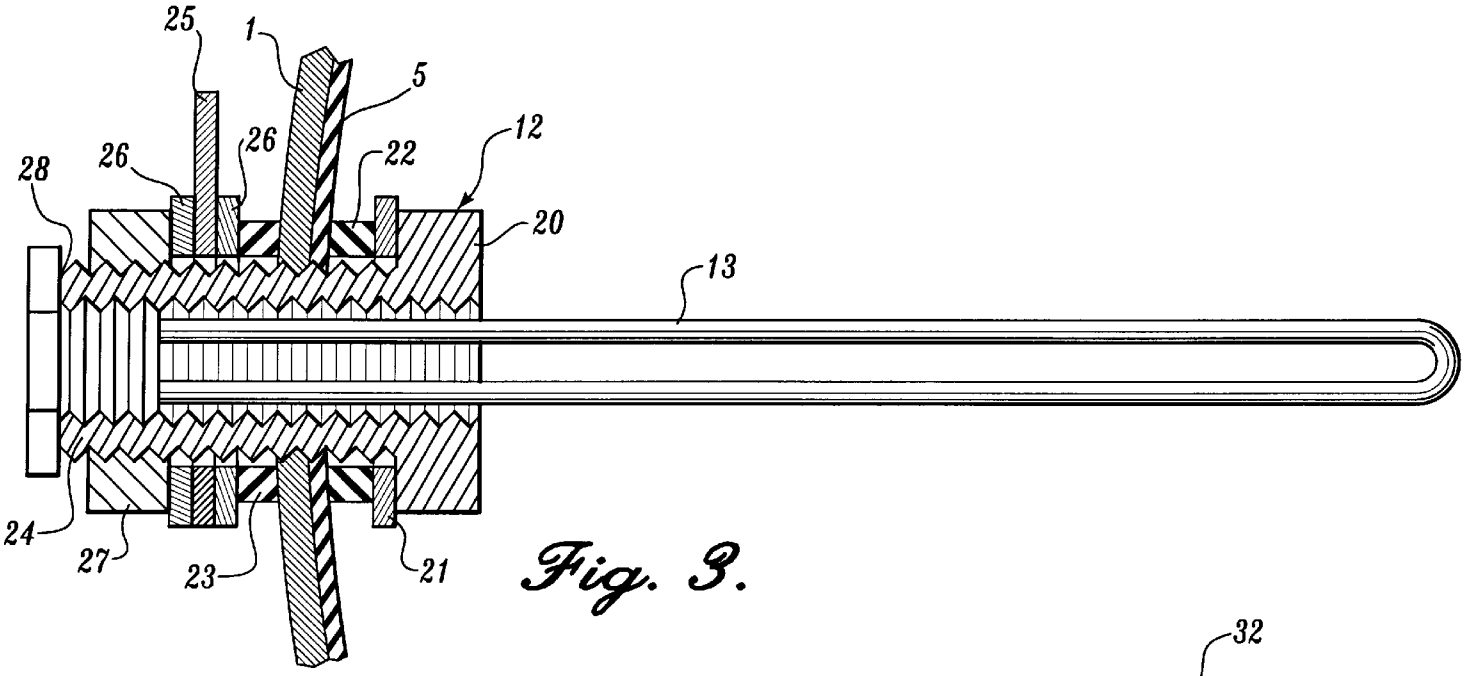
FIG. 3 and FIG. 4 are enlarged, fragmentary, detail views of components of the water heater construction of FIG. 1 and FIG. 2, with parts shown in section.

Through hull fittings 12 are provided for upper and lower heating elements 13. While two vertically spaced elements are shown, a single element, or more than two, could be used. A fitting 12 is shown in detail in FIG. 3 (in all figures the dimensions of the parts are exaggerated for ease of description and illustration). The main body of the fitting has an enlarged head 20 positioned at the inside of the water heater. Head 20 engages a rigid washer 21 which, in turn, compresses a circular, resilient gasket 22. Gasket 22 has an outer surface, i.e., adjacent to the liner 5 and cylindrical shell 1, which is curved to match the curvature of the shell. At the external side of the water heater, another circular gasket 23 is slid over the shank 24 of the fitting, this time with an inner surface engaged against the shell 1 and curved to match the curvature of the exterior of the shell. A mounting bracket 25 for electrical components of the water heater, such as a thermostat, can be sandwiched between washers 26, and the fitting secured in position by a nut 27. The shank 24 of the fitting 12 has internal threads for receiving the external threads of the mounting bolt 28 of the heating element 13.

Figure 4:
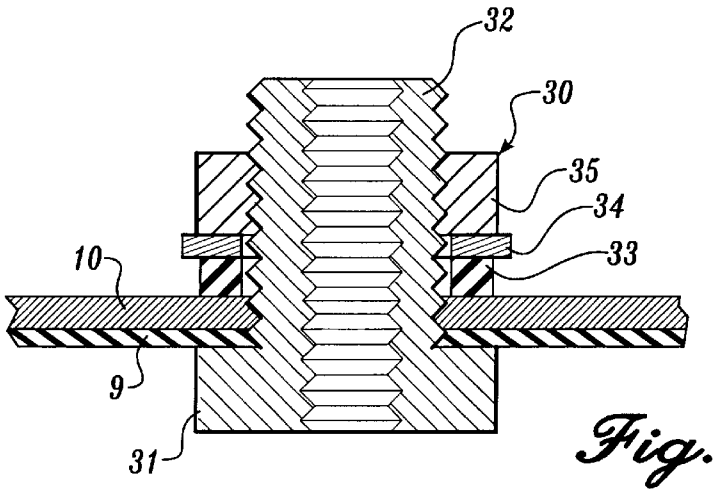

FIG. 4 illustrates the construction of a fitting 30 for one of the holes in the top plate 10 and gasket 9. The enlarged head 31 of the fitting is located underneath the gasket, with the shank 32 extending upward therefrom. A circular gasket 33, washer 34, and nut 35 are disposed above the top plate 10.

Returning to FIG. 2, a drain valve 16 will be provided toward the bottom of the liner and shell, and an additional drain valve 17 toward the top. Valve 17 opens to the area between the shell 1 and liner 5 and can be used to detect failure of the liner because water leaking through the liner will be forced upward. Valve 17 also is used to vent air during filling of the tank. During assembly of the water heater, or during liner replacement, it is possible that some shifting of the liner relative to the shell will occur. It may be desirable to coat the liner with a high temperature, nontoxic grease or slippery powder to prevent the liner from sticking and causing undesirable localized stress as the water heater is filled.

The liner design prevents water from coming into contact with metal components of the water heater, including the shell, and thereby prevents water or electric induced corrosion to metal surfaces.

A major advantage of the new construction is the simplicity of access and replacement of components for maintenance. If the liner fails, the top plate 10 can be removed and the fittings 12 disconnected, so that a new liner can be installed quickly and easily. Similarly, wires and control circuitry, represented by box 18 in FIG. 2, can be contained within a cover plate 15 secured to the shell. If the heating elements or electronics fail, access and replacement is easy from the exterior of the water heater without the liner being breached. Unlike known designs, there is no inner insulating layer that can restrict access to potentially repairable or replaceable components, even the electrical wiring.

The entire water heater construction can be surrounded by an insulative blanket or cover, preferably a drawstring bag, represented diagrammatically at 19 in FIG. 2, with the amount of insulation selected based on the location of the water heater. Preferably, the bag has ties at both ends, and a separate insulative top to fit over the top plate 10 and around any inlets and outlets. For example, FIG. 2 shows the inlet pipe 29. At any rate, when the insulative drawstring bag is in place, the top preferably is drawn over the separate insulating cover. When removed, the bag has all of the insulation, as compared to known constructions in which insulation is incorporated into a jacket and therefore is hard or impossible to salvage or recycle.

Preferably, the base 2 is rectangular or square and has corner portions extending beyond the periphery of the shell. As seen in FIG. 2, the base can be bolted or otherwise secured to the floor or a stand by pins, such as bolts, extending through the corner portions, to meet seismic regulations and prevent toppling during an earthquake, for example. In addition, tie-downs, brackets, or cables can be secured to the top plate, such as by use of one or more of the clamp bolts 11. Such a tie down bracket 36 is represented in broken lines in FIG. 2. Since the base and top plates are strong structural members, reliable seismic protection can be achieved without complicated and expensive halters required by conventional designs.

Figure 5:
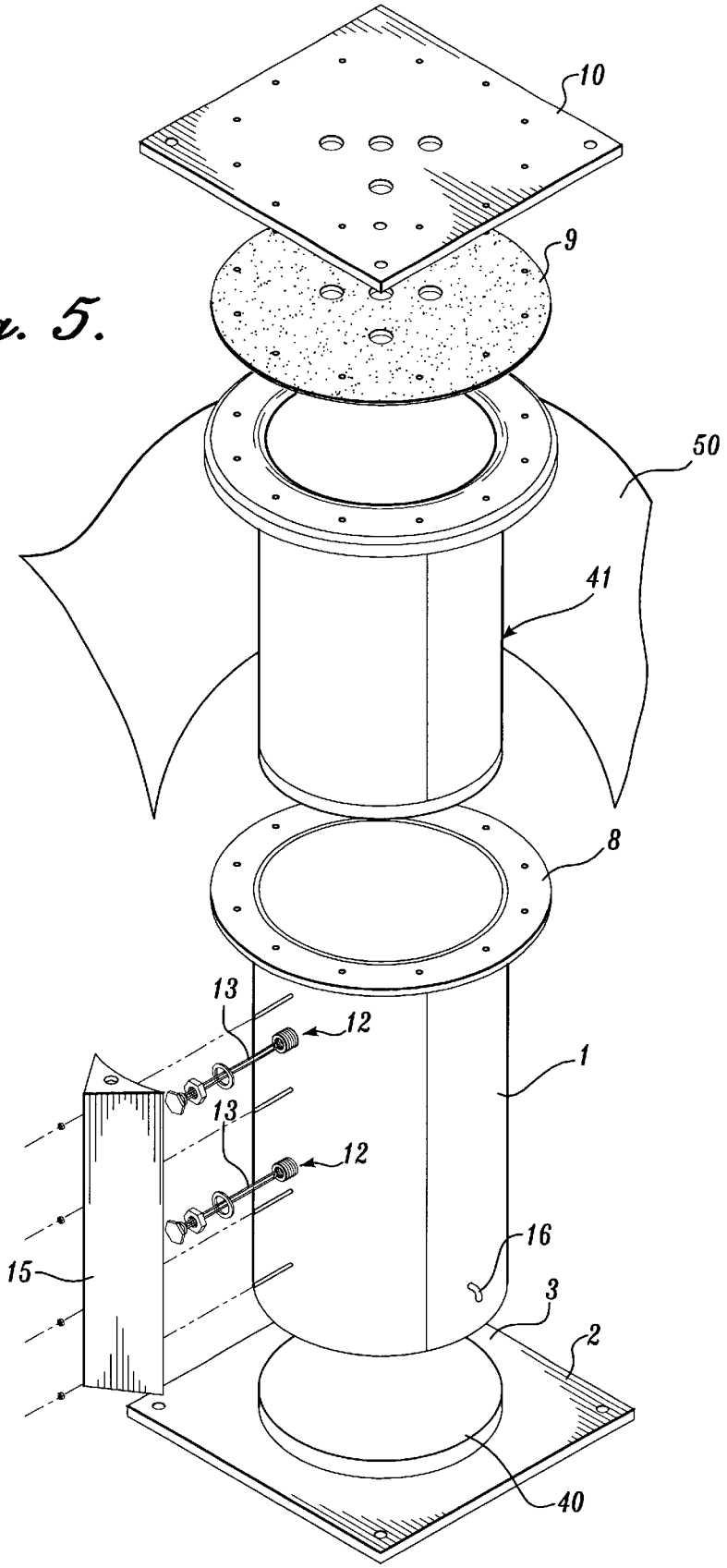
FIG. 5 is a top perspective of another water heater construction in accordance with the present invention, with parts shown in exploded relationship.
Figure 6:
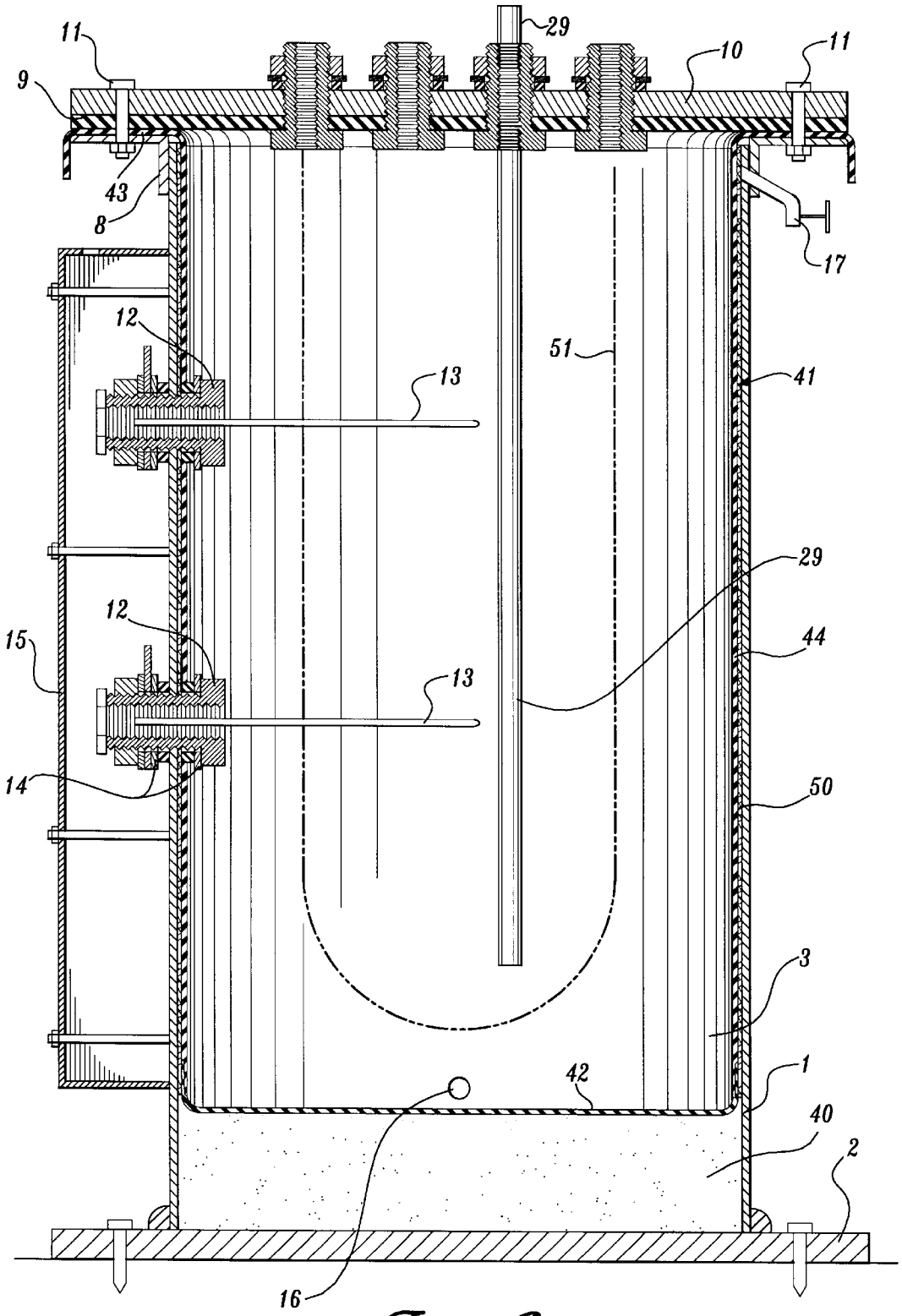
FIG. 6 is a vertical section of the water heater construction of FIG. 5, with the parts assembled.
Figure 7:
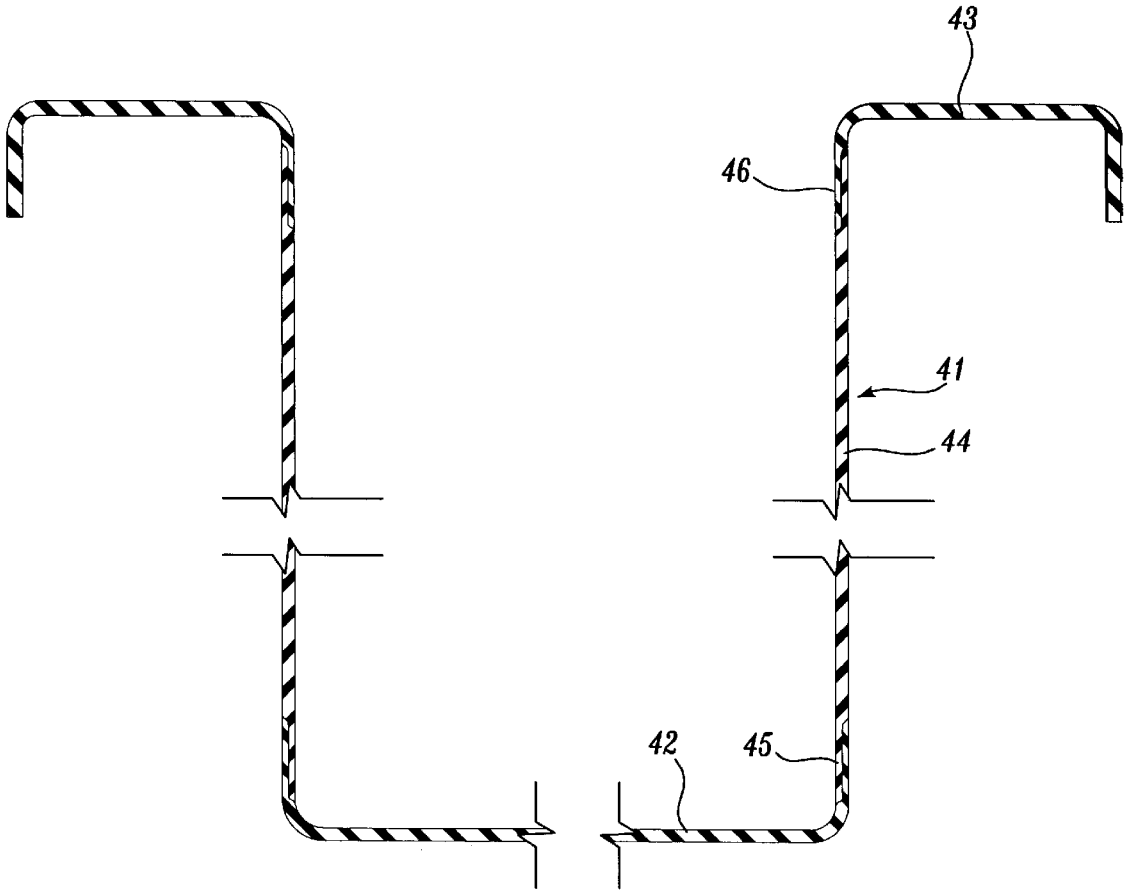
FIG. 7 is a diagrammatic vertical section of a component of the water heater of FIG. 5 and FIG. 6.

The embodiment of FIGS. 5–7 is similar to the embodiment previously described. A thin rigid shell 1 is secured to a base 2. In this embodiment, a cylindrical insulating disk 40 fills the bottom portion of the shell and has a flat top surface. The liner 41 is substantially cylindrical, closed at the bottom 42 (FIG. 6) and open at the top. The top portion of the liner has an annular lip 43 extending outward from the upright wall 44. The lip 43 fits over the flange 8 of the shell 1, and the top of the liner is closed by the gasket 9 and top plate 10. The through hull fittings 12 for the heating elements 13 are identical to those previously described, as are the fittings 30 that extend through the gasket 9 and top plate 10. Top plate 10 is secured to the flange 8, such as by bolts 11. A drain valve 16 is located in the bottom portion of the water heater, and a top valve 17 opens to the area between the shell 1 and liner 5, as previously described.

One construction for the liner is illustrated in FIG. 7. The bottom 42 can be formed in one piece with an upright rim portion 45. The wall 44 of the liner can be formed from a second piece, and have its bottom end portion secured to the rim 45 by any permanent fastening means, such as by heat welding or adhesive. The top lip 43 of the liner can be formed as a third piece with a downward extending rim portion 46 secured to the top end portion of the wall 44. An alternative is to form the bottom 42 and wall 44 in one piece, or to form the entire liner in one piece.

Another modification of the embodiment of FIGS. 5–7 is the provision of a quantity of water soluble, nontoxic dye between the outside wall of the liner 41 and the inside wall of the shell 1. One way this can be achieved is by provision of a sheet 50, such as porous paper, impregnated with the dye. The sheet can be wrapped around the liner prior to insertion in the shell, or can be used to line the shell prior to insertion of the liner. Should any type of rupture or leak occur, dye will infuse into the water heater and be detected during normal use. The dye also could be provided as a coating on the liner or inside the shell. Preferably the dye will be of a type that is not bleached by chlorine.

In either embodiment, the water heater can be quickly and easily disassembled for replacement of the liner or servicing or replacement of other components. Depending on the application, different ratings of heating elements may be desired, and the appropriate wattage selected without modification to the remainder of the water heater. Other heat sources can be used. For example, broken line 51 in FIG. 6 represents a heat exchanger that can be looped through the tank. The heat exchanger could carry heated coolant from a marine motor, for example, to supplement the heating elements 13.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A water heater comprising:

a rigid shell having an open interior and an open top;

a liner of flexible, water impervious, nonmetal material separate from but received within the open interior of the shell, for holding a quantity of water, the shell providing structural support for the liner;

a valve communicating between the space between the liner and the shell and disposed in the upper portion of the shell;

a top plate secured to the shell by removable fasteners for normally closing the top of the shell but openable to expose the liner for replacement thereof; and a heating element for heating water contained within the liner.

2. The water heater defined in claim 1, in which the shell has a horizontal flange adjacent to the open top, the liner having a lip portion extending over the flange, and the top plate being removably fastened to the flange to clamp the lip portion of the liner to the flange.

3. The water heater defined in claim 1, including a through hull fitting extending from inside the liner to the outside of the shell, the heating element being fitted in the through hull fitting.

4. The water heater defined in claim 1, including a baseplate, the rigid shell having a bottom end secured to the baseplate.

5. The water heater defined in claim 4, including a disk of insulative material fitted in the bottom portion of the shell and supported on the baseplate.

6. A water heater comprising:

a rigid shell having an open interior and an open top;

a liner of flexible, water impervious, nonmetal material separate from but received within the open interior of the shell, for holding a quantity of water, the shell providing structural support for the liner;

a quantity of dye interposed between the liner and the shell;

a top plate secured to the shell by removable fasteners for normally closing the top of the shell but openable to expose the liner for replacement thereof; and a heating element for heating water contained within the liner.

7. The water heater defined in claim 6, including a porous sheet interposed between the shell and the liner, the sheet being impregnated with dye for coloring water held by the liner in the event of a breach of the liner.

8. The water heater defined in claim 1, including a jacket of insulation material substantially surrounding the rigid shell.

9. The water heater defined in claim 8, in which the jacket is designed to be removable for exposing the exterior of the rigid shell.

10. A water heater comprising:

a rigid shell having an open interior and an open top;

a liner of flexible, water impervious, nonmetal material separate from but received within the open interior of the shell, for holding a quantity of water, the shell providing structural support for the liner;

a top plate secured to the shell by removable fasteners for normally closing the top of the shell but openable to expose the liner for replacement thereof;

a seismic tie down bracket carried by the top plate; and a heating element for heating water contained within the liner.

* * * * *